US009121157B2

(12) United States Patent
Wasiuta et al.

(10) Patent No.: US 9,121,157 B2
(45) Date of Patent: Sep. 1, 2015

(54) MANHOLE RISER EXTENSION ASSEMBLY

(71) Applicant: WILLERDING ACQUISITION CORP., O'Fallon, MO (US)

(72) Inventors: Kenneth Michael Wasiuta, Foristell, MO (US); Scott R. Peters, Warrenton, MO (US); Gary Bertolucci, Chesterfield, MO (US)

(73) Assignee: Willerding Acquisition Corp., O'Fallon, MO (US)

( * ) Notice: Subject to any disclaimer, the term of this patent is extended or adjusted under 35 U.S.C. 154(b) by 0 days.

(21) Appl. No.: 14/269,683

(22) Filed: May 5, 2014

(65) Prior Publication Data

US 2014/0328622 A1 Nov. 6, 2014

Related U.S. Application Data

(60) Provisional application No. 61/819,419, filed on May 3, 2013, provisional application No. 61/819,900, filed on May 6, 2013.

(51) Int. Cl.
*E02D 29/14* (2006.01)

(52) U.S. Cl.
CPC ..... *E02D 29/1409* (2013.01)

(58) Field of Classification Search
USPC ..... 404/25, 26; 454/48; 137/371; 52/19, 20
See application file for complete search history.

(56) References Cited

U.S. PATENT DOCUMENTS

| | | | | |
|---|---|---|---|---|
| 1,517,871 | A | 12/1924 | Thompson | |
| 3,218,943 | A | 11/1965 | Bowman | |
| 3,773,428 | A | 11/1973 | Bowman | |
| 3,891,337 | A | 6/1975 | McCoy | |
| 4,097,171 | A | 6/1978 | Fier | |
| 4,188,151 | A * | 2/1980 | Hall | 404/26 |
| 4,225,266 | A | 9/1980 | Fier | |
| 4,302,126 | A | 11/1981 | Fier | |
| 4,466,219 | A * | 8/1984 | Campolito | 52/20 |
| 4,690,584 | A | 9/1987 | LeBaron | |
| 4,995,757 | A | 2/1991 | Prescott | |
| 5,221,155 | A * | 6/1993 | Neil | 404/26 |
| 5,462,386 | A * | 10/1995 | Prescott | 404/26 |
| 5,482,400 | A * | 1/1996 | Bavington | 404/25 |
| 5,785,452 | A * | 7/1998 | Milo et al. | 404/25 |
| 6,371,688 | B1 * | 4/2002 | Yang et al. | 404/26 |
| 6,955,498 | B1 * | 10/2005 | McCuan et al. | 404/25 |
| 7,165,911 | B2 * | 1/2007 | Fier | 404/26 |
| 2002/0192023 | A1 * | 12/2002 | McNeely | 404/26 |
| 2009/0277099 | A1 * | 11/2009 | Ogieglo | 52/19 |

FOREIGN PATENT DOCUMENTS

| | | |
|---|---|---|
| CA | 1285167 | 7/1988 |

* cited by examiner

*Primary Examiner* — Matthew D Troutman
(74) *Attorney, Agent, or Firm* — Matthews Edwards LLC

(57) ABSTRACT

A manhole riser extension assembly including separate upper and lower spacer rings which are assembled utilizing tabs that extend downwardly from the upper spacer ring about the lower spacer ring, and locking elements in association with the lower ring that cooperatively engage and bear radially outwardly against the tabs, respectively, to urge and/or lock the tabs against an inner surface of the manhole frame bounding the manhole cover seat, or to penetrate the tabs and bear against the inner surface, to hold the assembly together and in place in the manhole frame, and such that a manhole cover is positionable in sitting relation on the lower spacer ring, bounded by the upper spacer ring for covering the manhole. Optional lift protections tabs can be provided at locations about the upper spacer ring, in position to be covered by paving material to supplement the holding of the assembly in place.

20 Claims, 8 Drawing Sheets

MANHOLE RISER EXTENSION ASSEMBLY

This application claims the benefit of U.S. Provisional Application No. 61/819,419, filed May 3, 2013; and U.S. Provisional Application No. 61/819,900, filed May 6, 2013.

TECHNICAL FIELD

The invention relates to a manhole riser extension assembly, and more particularly, including separate upper and lower spacer rings which are assembled utilizing tabs that extend downward from the upper spacer ring about the lower spacer ring, and locking elements in association with the lower ring that cooperatively engage and bear radially outward against the tabs, to urge and/or lock the tabs against an inner circumferential surface of the manhole frame bounding the manhole cover seat, to hold the assembly together and in place in the manhole frame, and such that a manhole cover is positionable in a sitting relation on the lower spacer ring, bounded by the upper spacer ring for covering the manhole. Optional lift protection tabs can be provided at locations about the upper spacer ring, in position to be covered by paving material to supplement holding the assembly in place, if desired.

BACKGROUND ART

U.S. Provisional Application No. 61/819,419, filed May 3, 2013; and U.S. Provisional Application No. 61/819,900, filed May 6, 2013, are incorporated herein by reference in their entirety.

Most underground facilities such as sanitary and storm sewers, utility conduits, and the like have manhole openings to provide access thereto. These manholes usually are located in, but not limited to, the street or roadway and consist of an inverted, generally bell-shaped metal manhole frame mounted on top of a brick or concrete base structure. This metal frame has an internal, horizontal ledge or seat for supporting the manhole cover so that the top of the cover is level with the top or upper surface of the frame and surrounding roadway pavement.

Problems arise in the resurfacing of the roadways in that a layer of pavement is placed on top of the existing pavement resulting in the manhole cover being below the top surface of the new pavement, causing a depression in the roadway. It is quite difficult and expensive to raise the existing manhole frame sufficiently to compensate for the added pavement. Thus, various devices and methods have been constructed and used which enable an existing manhole cover to be raised to the level of the new pavement surface without raising the existing manhole frame. Some examples of these devices and methods are shown in U.S. Pat. Nos. 1,517,871, 3,218,943, 3,773,428, 3,891,337, 4,097,171, 4,225,266, 4,302,126, 4,690,584, and 4,995,757. See also, Canadian Patent No. 1,285,167.

Many of these prior art devices use a metal frame formed with a gap wherein the metal frame sits upon a generally horizontal surface of the manhole frame, typically the manhole cover seat, and include a device for expanding the frame outwardly into abutting engagement with a upwardly outwardly extending conical or tapered surface formed on the manhole frame bounding the cover seat, which prior to the installation of the new pavement, received the manhole cover thereon. However, in certain manhole frames, this tapered surface forms an excessively large obtuse angle with the adjacent horizontal ledge resulting in the riser frame moving upwardly from its seated position within the frame when forced outwardly by the expansion device and subjected to various forces, making it difficult to retain the riser frame assembly within the manhole opening. It has been found that the horizontally outwardly extending force component exerted by the expansion device is not sufficient to retain the riser frame within the manhole opening due to the excessive large taper or angle of the conical surface of the manhole frame. Furthermore, it has been found that sliding and shifting of the riser assembly can occur within the manhole opening providing an unwanted movement of the riser assembly, which could occur over time caused by thermal expansion of the ground or supporting structure or movement by snow plows or repetitive motion of vehicle tires moving over the manhole cover.

U.S. Pat. No. 4,690,584 shows one manner of solving this problem by the use of concrete reinforcing steel bars welded to the riser frame. The bars are bent outwardly beneath a retaining lip of the manhole frame to secure the riser assembly in position. Although this construction may provide a suitable solution, it requires a number of additional manufacturing steps such as welding the bars to the riser frame and then requiring the welded bars to be bent inwardly after placement into the manhole frame by repeatedly striking the bars with a hammer to bend the bars in position. However, the bent bars may not provide a secure lock with the adjacent manhole frame still resulting in some movement of the riser frame within the manhole frame causing rattling and other unwanted results. Also, if such bendable bars are used with riser assemblies which have an outward expansion device, it does not provide any assistance in overcoming the unwanted movement of the riser assembly due to the large angle of the manhole frame conical surface.

U.S. Pat. No. 7,165,911 proposes to overcome the above problem using outwardly projecting tabs at locations about an expandable ring, that engage the underside of a surface of the manhole frame. However, this adds manufacturing complexity.

What is sought is a manhole riser extension apparatus which overcomes one or more of the disadvantages and shortcomings, set forth above.

SUMMARY OF THE INVENTION

What is disclosed is a manhole riser extension assembly which overcomes one or more of the disadvantages and shortcomings, set forth above.

According to a preferred aspect of the invention, the assembly includes separate upper and lower spacer rings which are assembled utilizing locking tabs that extend downwardly from the upper spacer ring so as to be disposed just outward of the lower spacer ring when the rings are sitting on the upper periphery or edge of a manhole cover seat of a conventional manhole frame, respectively. In this regard, the upper spacer ring is sized to correspond to the sectional extent or overall width dimension of the upper surface of a manhole frame with which the assembly is to be used, and the lower spacer ring is sized to correspond to the sectional extent or overall width of the manhole cover seat within the manhole frame. The outer surface of the lower spacer ring, may or may not have a taper corresponding to that of the inner surface of the manhole frame bounding the manhole cover seat. The locking tabs are oriented at an angle that corresponds to the tapered sides of the manhole frame. The assembly includes locking elements at corresponding locations in association with the lower spacer ring, configured to cooperatively engage and bear radially outwardly against the locking tabs, respectively, to urge them forceably against the inner surface of the manhole frame, and/or to penetrate the tabs for a positive lock to the inside surface of the manhole frame bounding the manhole cover seat, to hold the rings together and in place in the manhole frame. A manhole cover is then positionable in sitting relation on the lower spacer ring, bounded by the upper spacer ring for covering the manhole.

As another preferred aspect of the invention, the locking elements comprise threaded fasteners, such as, but not limited to, lock bolts, threadedly disposed in radially outward extending holes through the lower spacer ring, threadedly engageable with that ring so as to bear against the associated tabs to urge and/or lock the tabs radially outward into contact with the associated surface of the manhole frame, with sufficient force for holding it in place. Because the tabs are located at spaced locations about the assembly, the forces exerted thereby are concentrated, and not distributed in the manner of an expanding ring.

As another preferred aspect of the invention, the lower spacer ring can have an optional split configuration, with ends disposed in a small spaced apart relation when the ring is in a relaxed or free state. This is advantageous for allowing the ring to be variable slightly in overall sectional extent, e.g., diameter, to accommodate variations in cross sectional size between different manhole frames. This is also advantageous when the locking elements are engaged with the locking tabs of the upper ring, as the lower ring can be radially compressed by an amount up to that for closing the spaced relation between the ends, to load the lower ring in compression, and resiliently, so that it acts to resiliently bias the locking elements, and thus the locking tabs radially outward. This resiliency and the forces that can be generated, enable the assembly to remain tightly held in place during thermal expansion and contraction cycles, and the like, and to prevent movement of the riser assembly upward as a result of the tapered shape of the inner surface of the manhole frame against which the locking tabs and/or locking elements bear, as has been a problem with prior known riser devices. In this regard, the split ring also enables the lower ring to be sized marginally smaller than the surface bounding the manhole cover seat of a manhole frame with which the assembly is to be used, to provide a small space outwardly about the lower ring when seated on the manhole cover seat, for receiving the locking tabs. This configuration of split ring and locking elements is also advantageous as it eliminates the need for the turnbuckles, and other mechanisms of the prior risers used for expanding the riser against the inner manhole frame surface.

According to another preferred aspect of the invention, optional lift protection tabs are provided at locations about the upper spacer ring, in position to be covered by paving material to supplement holding the assembly in place.

As another advantage, the use of separate upper and lower spacer rings allows providing each in different sizes, including both vertical and horizontal dimensions, as well as shapes, including, but not limited to, round, oval, rectangular, polygonal, and the like, and that can be matched to a particular application, to accommodate different manhole frame and/or cover dimensions and configurations, and different thicknesses of paving materials to be applied about the riser assembly. The separate components are also lighter and easier to handle compared to a unitary construction. Additionally, during assembly, it is contemplated according to the invention, for shim rings or the like to be placed on the manhole cover seat below the lower ring to raise the assembly to a required height, or on the upper surface of the lower ring (forming the new manhole cover seat), to properly position the cover height-wise when resting thereon, and to be used to position the upper ring at a required elevation, to accommodate different height requirements. In this latter regard, locking tabs can be provided in extended lengths, and trimmed as required, for a particular application.

According to another preferred aspect of the invention, the locking tabs are constructed of a material and configured to be biasable or deformed radially outward by forceable contact with the respective locking elements, sufficiently sufficient for bearing against the associated manhole frame surface, for holding the assembly in position. Additionally, the locking elements can have points or drill tips, and the locking tabs are preferably configured to allow the points to penetrate the tabs so as to bear against and/or lock to the manhole frame, for holding the assembly in position. In this latter regard, the points or drill tips of the locking elements, e.g., lock bolts, can be of a suitable hardened material for providing desired engagement with the frame surface. Suitable materials for the tabs can include, but are not limited to, ductile carbon and stainless steels, and other metals, and composite materials. The outer surfaces of the tabs can also be optionally textured or include features, e.g., points or cleats, for increasing frictional engagement with the inner manhole frame surface. As another optional feature, the locking tabs can be configured to be variably positionable height-wise in relation to the lower spacer ring and manhole cover seat of the manhole frame, for instance, but not limited to, using selected height spacers, disposed between the lower spacer ring and the inner surface of the manhole frame, for achieving a desired height in relation to the new pavement surface.

DETAILED DESCRIPTION OF PREFERRED EMBODIMENTS OF THE INVENTION

Figure 1:
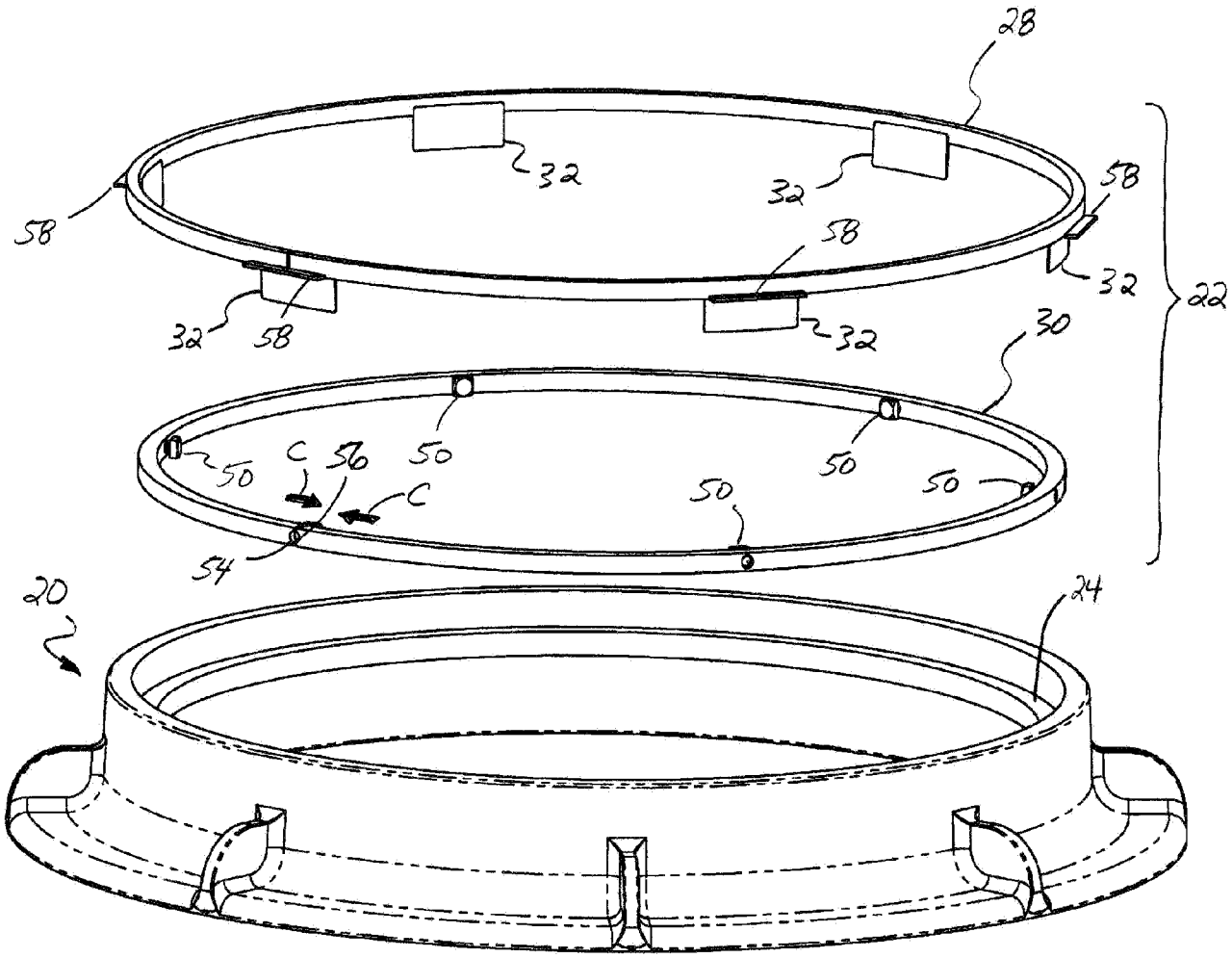
FIG. 1 is a perspective view of a representative prior art manhole frame, and aspects of a manhole riser extension assembly of the invention, in exploded form thereabove.

Referring now to the drawings, In FIG. 1 a representative well-known, commercially available manhole frame 20 is shown, along with a manhole riser extension assembly 22 constructed and operable according to the teachings of the invention, for installation in association with a manhole cover seat 24 of frame 20, for raising the level of a manhole cover 26 (see for comparison, FIGS. 4 and 7) relative to frame 20.

Manhole cover 26 can also be of well-known, commercially available construction. Manhole riser extension assembly 22 of the invention generally includes an upper spacer ring 28, and a lower spacer ring 30, which are assembled utilizing locking tabs 32 that extend downwardly from upper spacer ring 28 so as to be disposed just outwardly of lower spacer ring 30 when rings 28 and 30 are sitting on the upper periphery or edge of a manhole cover seat 24 of a conventional manhole frame, such as frame 20. Details of the assembly 22 follow below.

Figure 4:
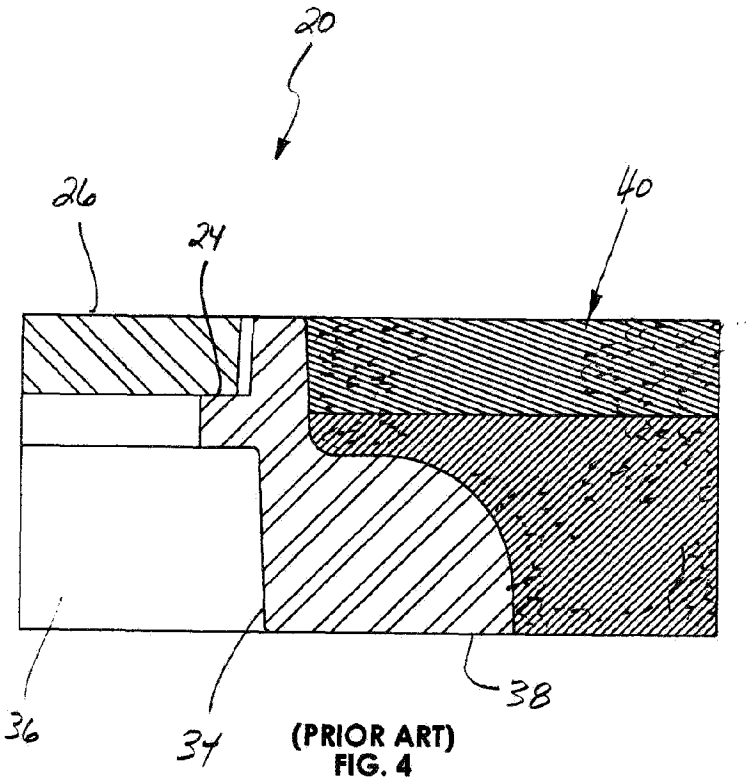
(PRIOR ART) FIG. 4
FIG. 4 is an enlarged fragmentary sectional view of the manhole frame along lines A-A of FIG. 2, and showing representative original asphalt beside the frame.
Figure 2:
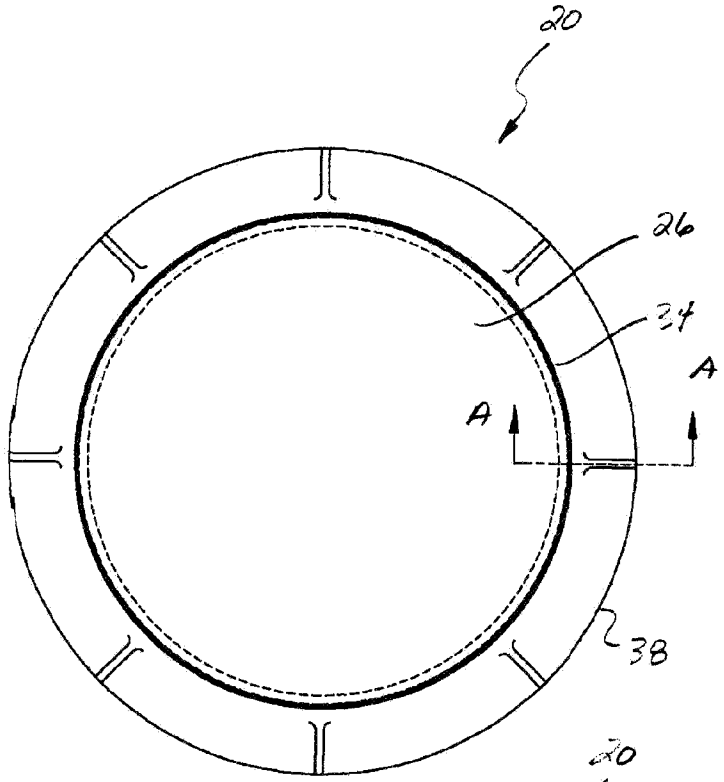
(PRIOR ART) FIG. 2
FIG. 2 is top view of the manhole frame of FIG. 1.
Figure 3:
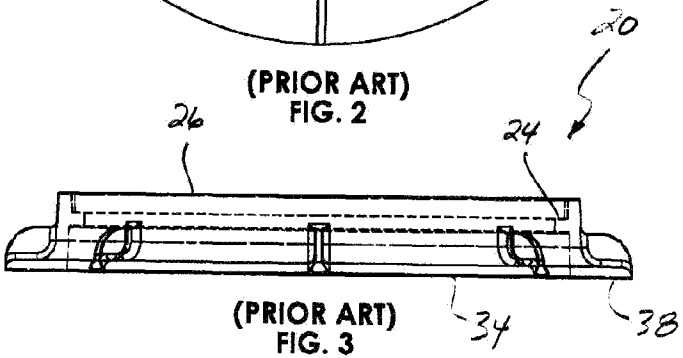
(PRIOR ART) FIG. 3
FIG. 3 is side view of the manhole frame.
Figure 5:
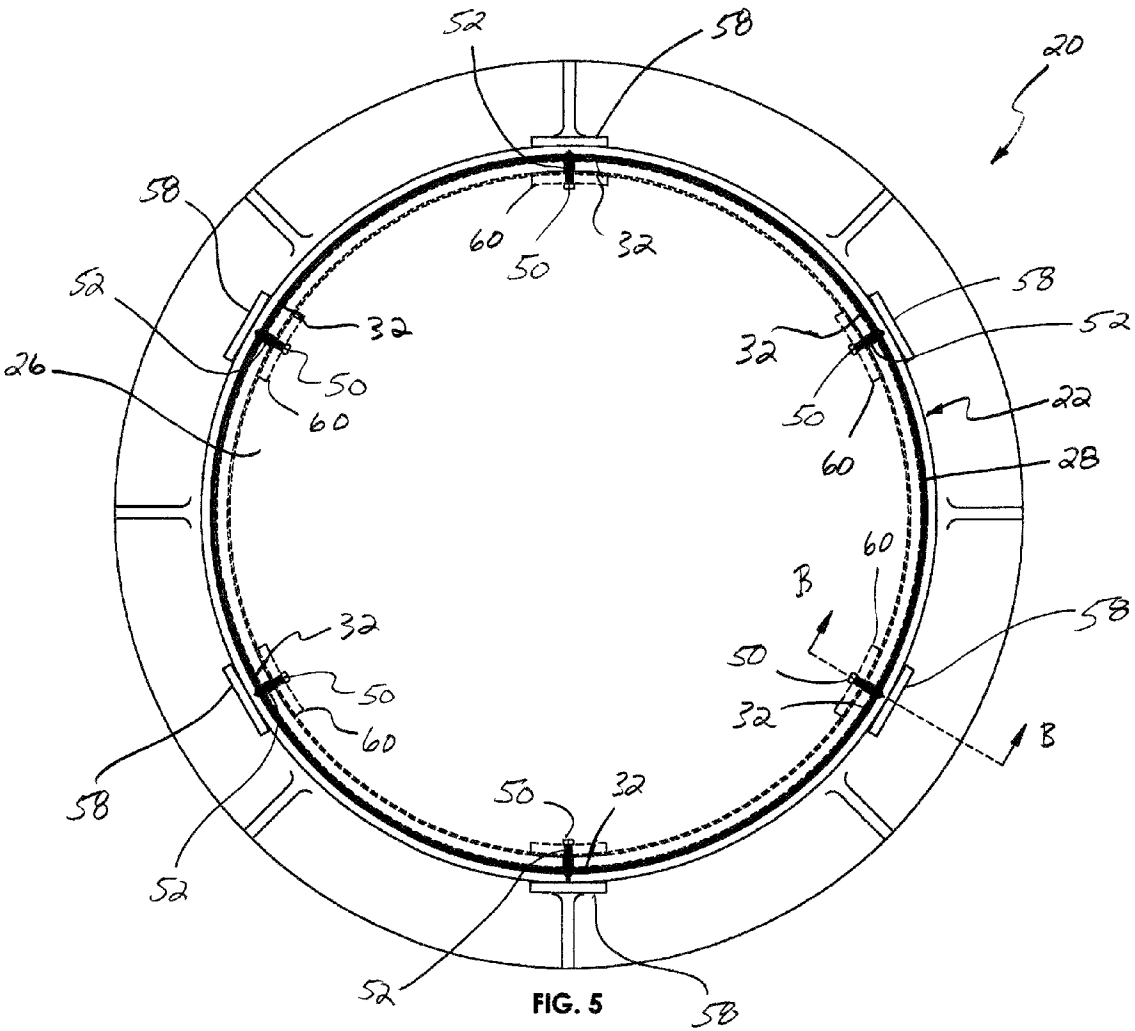
FIG. 5 is a top view of the manhole frame, with the manhole riser extension assembly of the invention, in place therein, as illustrated by hidden lines below the manhole cover.

First, briefly also referring to FIGS. 2, 3, and 4, the construction and operation of manhole frame 20, intended to be representative of a wide variety of known prior art manhole frames, will be explained. Manhole frame 20 has a generally upstanding annular body 34 bounding and defining an opening 36 therethrough, and incorporating cover seat 24 about opening 36 for supporting a manhole cover, such as cover 26, in covering relation thereto. Opening 36 will typically connect with a downwardly extending hole, cavity, or passage, (not shown) which is desirably covered when not in use. Frame 20 additionally includes, as is typical, an outer flange 38 extending at least partially thereabout. As shown in FIG. 4 to illustrate a typical installation, in use, flange 38 will be covered with some kind of paving material, typically asphalt, gravel, brick, concrete, etc. to help anchor frame 20 in position. It will typically be desired for the upper end of frame 20 and cover 26 to be about even height-wise with the upper surface of the pavement, as shown. With many paving materials, the upper surface of the pavement is subject to wear, compression and displacement (particularly asphalt), erosion, damage, etc., necessitating coverage with an additional layer or layers of paving materials, e.g., asphalt. When this occurs, a riser (not shown) is typically added to frame 20, to level the manhole cover with the new pavement. Over the years or with heavy use, several additional layers may be applied, and additional riser assemblies of the invention can be used. Prior art risers and associated disadvantages and shortcomings are discussed above under the Background Art heading.

Figure 6:
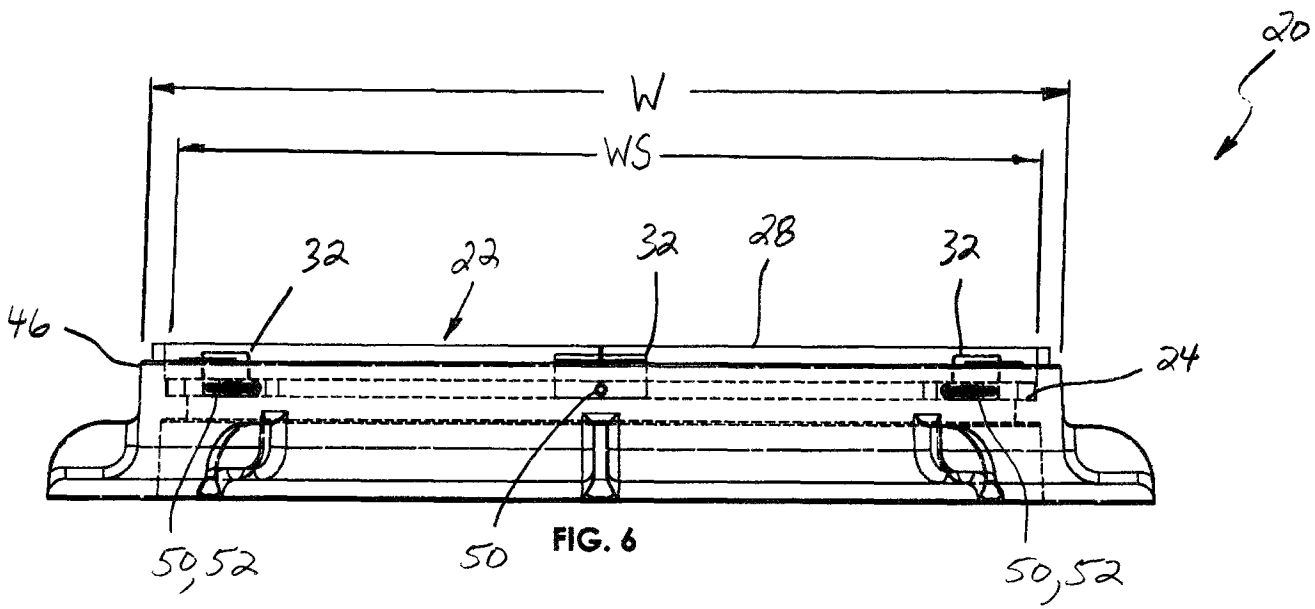
FIG. 6 is a side view of the manhole frame and riser extension assembly of the invention, as shown by hidden lines.
Figure 7:
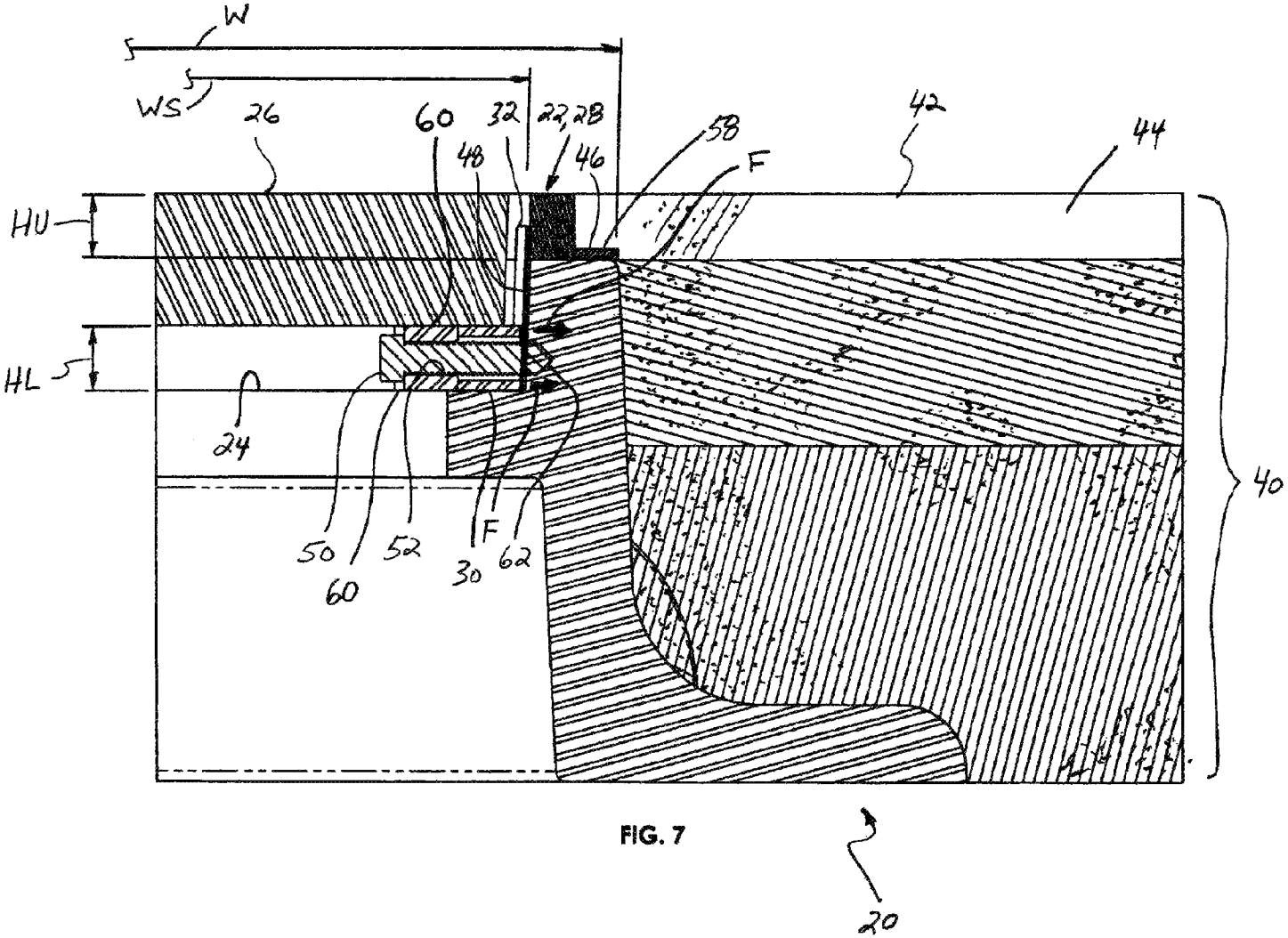
FIG. 7 is an enlarged fragmentary sectional view along lines B-B of FIG. 5, similar to FIG. 4, additionally showing new asphalt beside the frame to illustrate riser requirements.

Referring also to FIGS. 5, 6, 7, and 8, manhole frame 20 is shown with manhole riser assembly 22 installed thereon. As just explained, the general intent of the use of riser assembly 22 will be to raise the height of cover 26 when installed, so as to be generally level with an upper surface 42 of an added layer 44 of paving material 40, as best shown in FIG. 7. To achieve this, upper spacer ring 28 is sized in overall sectional extent, that is, generally horizontal, to correspond to a sectional extent or overall width dimension W of an upper surface 46 of manhole frame 20, and lower spacer ring 30 is sized to correspond to the sectional extent or overall width WS of cover seat 24 within manhole frame 20, as illustrated in FIGS. 6 and 7. Upper spacer ring 28 and lower spacer ring 30 will preferably have height dimensions HU and HL, respectively, to enable achieving a required rise, and to accommodate the height of a manhole cover with which the assembly will be used. The outer surface of lower spacer ring 30, may or may not have a taper corresponding to that of an inner surface 48 of manhole frame 20 bounding cover seat 24 (see FIG. 7). Here, it should be understood that it is the intent that upper ring 28 sit on upper surface 46 of frame 20, and that lower ring 30 be manually installable on cover seat 24. Locking tabs 32 can be vertical to best fit against a straight inner surface 48, or, if surface 48 is tapered, tabs 32 can be oriented at an angle that corresponds about to the angle of taper. If desired, tabs 32 can be sufficiently malleable to allow adjustments in the field in this regard.

Manhole riser assembly 22 includes at least one locking element 50 for fixing at least ring 28 in position once installed, and preferably including to lock ring 30 in position also. As a non-limiting, preferred manner of performing this locking function, a plurality of locking elements 50 are disposed at locations about lower spacer ring 30, configured to cooperatively engage and bear radially outward against locking tabs 32, respectively, to urge and/or lock them forceably against inner surface 48 of manhole frame 20, and/or to penetrate tabs 32, for a positive lock or connection to the surface 48, to hold rings 28, 30 together and in place in manhole frame 20. In this latter regard, elements 50 can have pointed and/or drilling tips 62 to facilitate penetration of tabs 32 and, if desired, into surface 48 to a sufficient extent for retention purposes (see FIG. 7). A manhole cover 26 is then positionable in sitting relation on lower spacer ring 30, bounded by upper spacer ring 28 for covering manhole opening 36.

As a preferred embodiment, locking elements 50 comprise threaded fasteners, such as, but not limited to, lock bolts, threadedly disposed in radially outward extending threaded holes 52 through lower spacer ring 30, and threadedly engageable with that ring or associated structure so as to bear against associated tabs 32 to urge the tabs radially outward into contact with inner surface 48 of manhole frame 20, with sufficient force for holding riser assembly 22 in place. Because tabs 32 are located at spaced locations about assembly 22, the forces exerted thereby are concentrated, and not distributed in the manner of an expanding ring. The concentrated forces also facilitate penetration of locking tabs 32 and surface 48 of frame 20 (see FIG. 7) if the elements are pointed or drill tipped. Locking tabs 32 are preferably constructed of a ductile carbon or stainless steel material and configured to be biasable or deformed radially outward by forceable contact with the respective locking elements 50, sufficiently for bearing against the associated manhole frame surface, e.g., surface 48, for holding assembly 22 in position. Points or drill tips 62 on elements 50 will be suitably configured and/or hardened.

As another preferred embodiment, lower spacer ring 30 can have an optional split configuration, with ends 54 and 56 (see FIG. 1) disposed in a small spaced apart relation when ring 30 is in a relaxed or free state. This allows ring 30 to be variable slightly in overall sectional extent, e.g., diameter, to accommodate variations in cross sectional size or width WS between different manhole frames. This is also advantageous when locking elements 50 are engaged with locking tabs 32 of upper ring 28, as lower ring 30 can be radially compressed (illustrated by arrows C in FIG. 1) by an amount up to that for closing the spaced relation between ends 54 and 56, to load lower ring 30 in compression, and resiliently, so that ring 30 acts to resiliently bias or force locking elements 50, and thus locking tabs 32 radially outward, as illustrated by arrows F in FIG. 7. This resiliency and the forces that can be generated, enable assembly 22 to remain tightly held in place during thermal expansion and contraction cycles, and the like, and to prevent movement of riser assembly 22 upward as a result of any tapered shape of inner surface 48 of manhole frame 20 against which locking tabs 32 and/or locking elements 50 bear. The split configuration of ring 30 also enables it to be sized marginally smaller than inner surface 48 bounding cover seat of a manhole frame with which the assembly is to be used, to provide a small space outwardly about lower ring 30 when seated on the manhole cover seat, for receiving locking tabs 50.

As an option, lift protection tabs 58 are provided at locations radially outward about upper spacer ring 28, in position to be covered by paving material to supplement holding assembly 22 in place, if desired or required for a particular application, as best shown in FIG. 7.

The above replacement paragraphs contain no new matter.

As another option, threaded holes 52 can be located through reinforcing blocks 60 provided on lower spacer ring 30 to strengthen that ring in proximity to and about locking tabs 50, if desired or required for a particular application.

Figure 8:
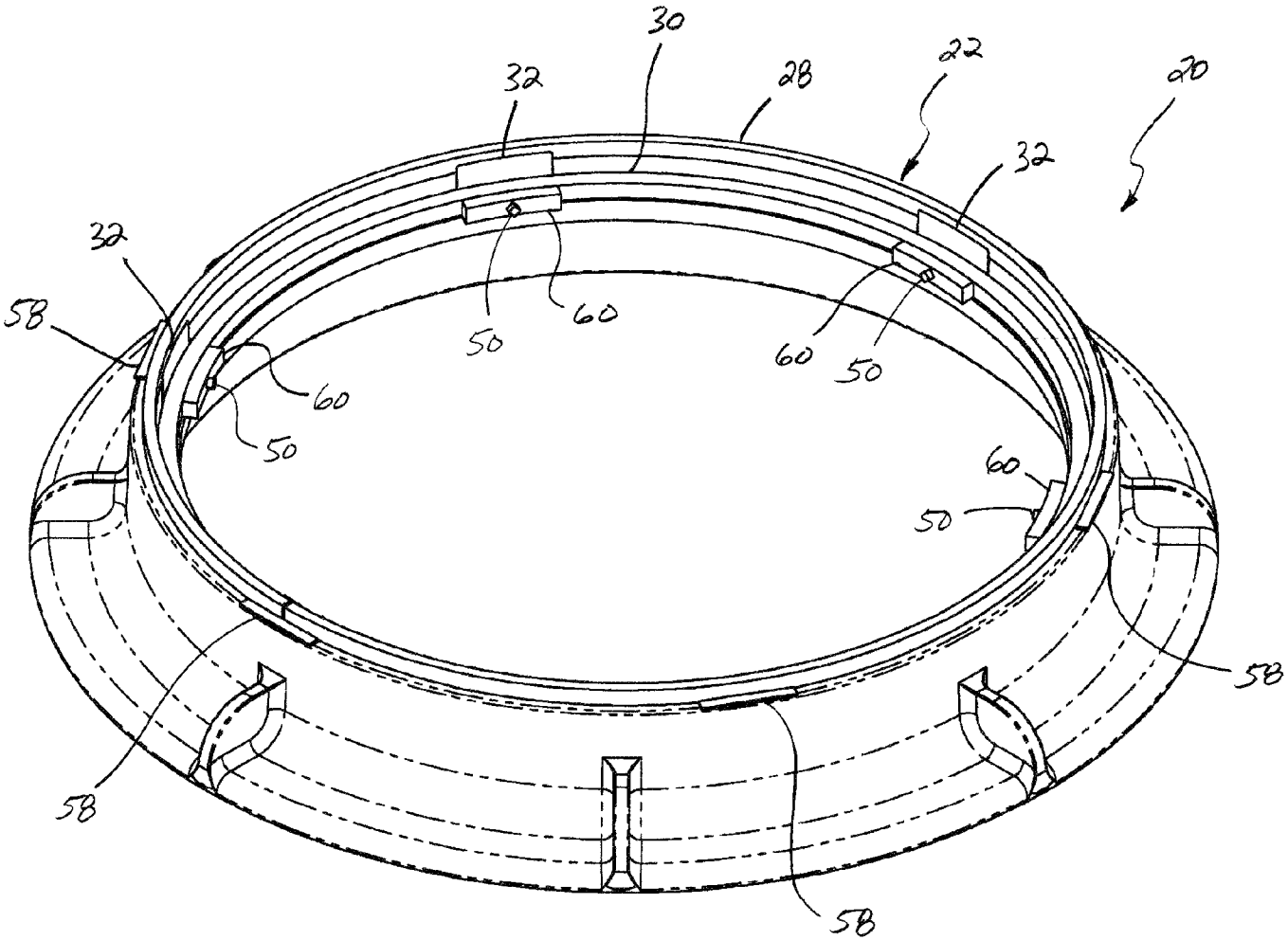
FIG. 8 is a perspective view of the manhole frame with the riser extension assembly of the invention installed and the manhole cover removed for clarity.
Figure 8A:
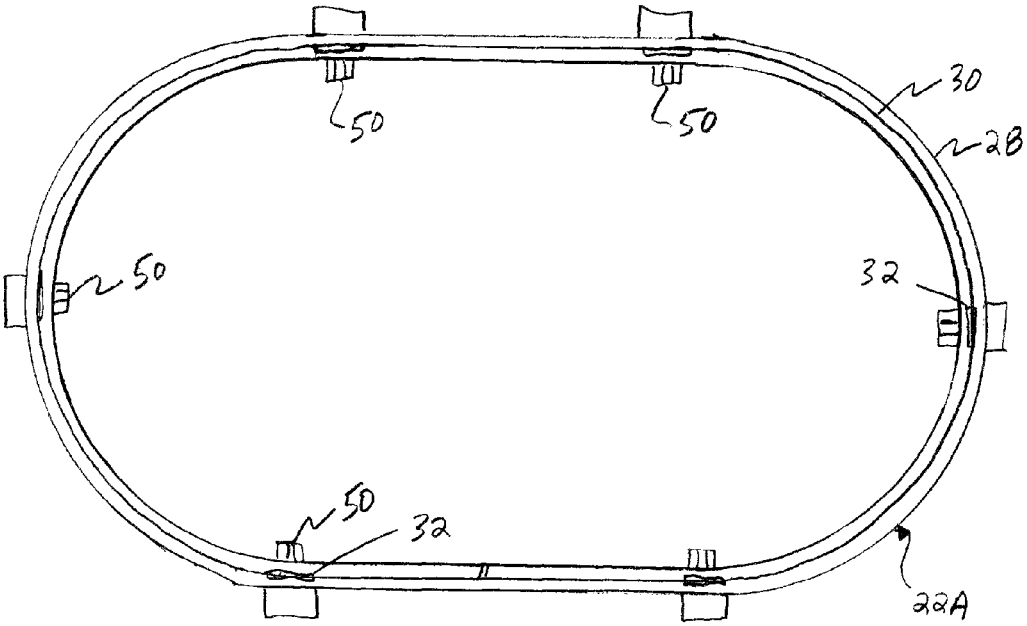
FIG. 8A is a simplified top view of an oval manhole riser extension assembly of the invention.
Figure 8B:
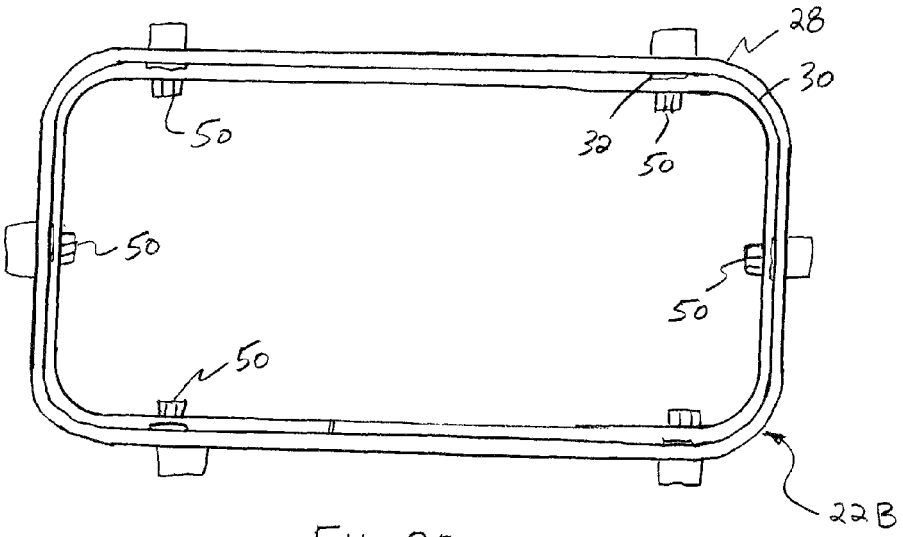
FIG. 8B is a simplified top view of a rectangular manhole riser extension assembly of the invention.
Figure 8C:
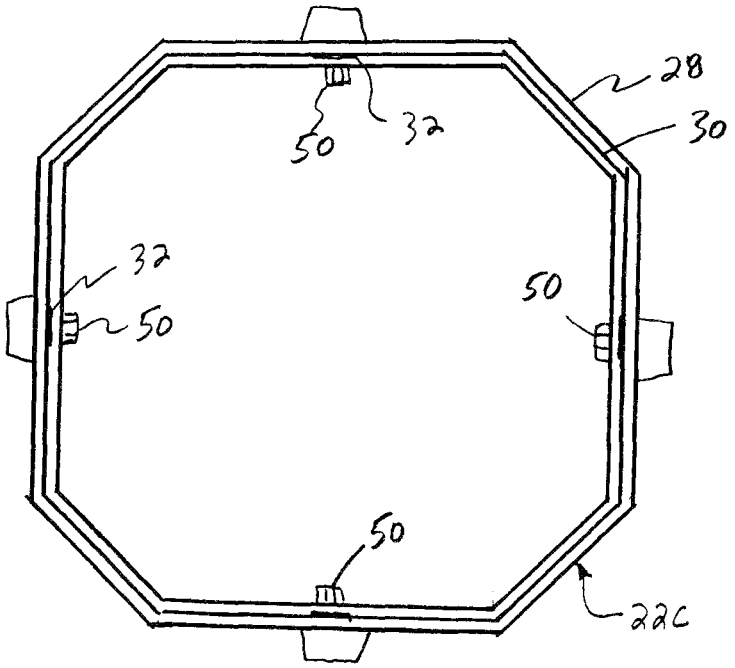
FIG. 8C is a simplified top view of a polygonal manhole riser extension assembly of the invention.

It should be recognized that manhole frames come in different sizes, including both vertical and horizontal dimensions, as well as shapes, including, but not limited to, round, oval, rectangular, polygonal, and the like, and that can be matched by a riser assembly of the invention, to accommodate different manhole frame and/or cover dimensions and configurations, and different thicknesses of paving materials to be placed about the riser assembly. See in this regard, the oval manhole riser extension assembly 22A in FIG. 8A; rectangular manhole riser extension assembly 22B in FIG. 8B; and the polygonal manhole riser extension assembly 22C in FIG. 8C. Except for the different overall shape, each of riser extension assemblies 22A, 22B, and 22C is constructed in essentially the manner described above and will include like parts as assembly 22, which parts being identified by like numerals, for example, upper and lower spacer rings 28 and 30, locking tabs 32, and locking elements 50, so as to function in essentially the same manner as riser extension assembly 22. Providing the rings 28 and 30 as separate components has been found to be lighter and easier to handle compared to a unitary construction, and allows mixing and replacing different components as required on an application by application basis, e.g., for matching a required rise, manhole cover thickness, etc.

Additionally, it is contemplated that the number of locking tabs 32 and locking elements 50 of assembly 22 and other riser ring assemblies according to the invention, can vary as desired or required for a particular ring assembly or application. It is also contemplated according to the invention, for shim rings or the like to be placed on the manhole cover seat below lower ring 30 to raise the assembly of the invention to a required height, or on the upper surface of the lower ring (forming the new manhole cover seat), to properly position the cover height-wise when resting thereon, and to be used to position the upper ring at a required elevation, to accommodate different height requirements. In this latter regard, locking tabs 32 can be provided in extended lengths, and trimmed as required, for a particular application.

Suitable materials for the rings 28 and 30, and locking tabs 32, can comprise, but are not limited to, ductile carbon and stainless steels or other metals, and composite materials. The outer surfaces of the tabs can also be optionally textured or include features, e.g., points or cleats, for increasing frictional engagement with the inner manhole frame surface. As another optional feature, the locking tabs can be configured to be variably positionable height-wise in relation to the lower spacer ring and manhole cover seat of the manhole frame, for instance, but not limited to, using selected height spacers, disposed between the lower spacer ring and the inner surface of the manhole frame, for achieving a desired height in relation to the new pavement surface.

In light of all the foregoing, it should thus be apparent to those skilled in the art that there has been shown and described a novel manhole riser extension assembly. However, it should also be apparent that, within the principles and scope of the invention, many changes are possible and contemplated, including in the details, materials, and arrangements of parts which have been described and illustrated to explain the nature of the invention. Thus, while the foregoing description and discussion addresses certain preferred embodiments or elements of the invention, it should further be understood that concepts of the invention, as based upon the foregoing description and discussion, may be readily incorporated into or employed in other embodiments and constructions without departing from the scope of the invention. Accordingly, the following claims are intended to protect the invention broadly as well as in the specific form shown, and all changes, modifications, variations, and other uses and applications which do not depart from the spirit and scope of the invention are deemed to be covered by the invention, which is limited only by the claims which follow.

What is claimed is:

1. A manhole riser extension assembly, comprising:

separate upper and lower spacer rings which are assembled utilizing tabs that extend downward from the upper spacer ring radially outward of and about the lower spacer ring, and locking elements in association with the lower ring that cooperatively engage and bear radially outward against the tabs, to urge and/or lock the tabs against an inner surface of the manhole frame radially outward of and bounding the manhole cover seat, to hold the assembly together and in place in the manhole frame, and such that a manhole cover is positionable in sitting relation on the lower spacer ring, bounded by the upper spacer ring for covering the manhole.

2. The manhole riser extension assembly of claim 1, further comprising lift protection tabs at locations about the upper spacer ring, in position to be covered by paving material to supplement holding the assembly in place.

3. The manhole riser extension assembly of claim 1, wherein the locking elements comprise lock bolts threaded into threaded holes through the lower spacer ring.

4. The manhole riser extension assembly of claim 1, wherein the lower spacer ring is biasable radially inward by the cooperative engagement and bearing of the locking elements against the tabs, so as to exert an outward directed radial force against the tabs.

5. The manhole riser extension assembly of claim 1, wherein the upper spacer ring has at least a vertical dimension that can be varied to accommodate different manhole covers, frames and pavement heights.

6. The manhole riser extension assembly of claim 1, wherein the locking tabs are configured to be biasable or deformed radially outward by forceable contact with the respective locking elements bearing against the inner surface of the manhole frame.

7. The manhole riser extension assembly of claim 1, wherein the spacer rings have a round shape.

8. The manhole riser extension assembly of claim 1, wherein the spacer rings have an oval shape.

9. The manhole riser extension assembly of claim 1, wherein the spacer rings have a polygonal shape.

10. The manhole riser extension assembly of claim 9, wherein the spacer rings have a rectangular shape.

11. The manhole riser extension assembly of claim 1, wherein the spacer rings have a polygonal shape.

12. The manhole riser extension assembly of claim 11, wherein the spacer rings have a rectangular shape.

13. A manhole riser extension assembly, comprising:

an upper spacer ring and a lower spacer ring, the upper spacer ring configured to sit on a horizontal upper surface of a manhole frame and the lower spacer ring configured to sit on a manhole cover seat of the manhole frame, and locking tabs depending from the upper ring, configured to be disposed between an outer periphery of the lower ring and an inner surface of the manhole frame and to be cooperatively engaged by locking elements associated with the lower ring, such that the locking elements bear radially outward against the locking tabs to force the locking tabs to bear against a surface of the manhole frame radially outward of and bounding the manhole cover seat, to hold the assembly together and on the manhole frame.

14. The manhole riser extension assembly of claim 13, further comprising lift projection tabs at locations about the upper spacer ring, in position to be covered by paving material to supplement holding the assembly in place.

15. The manhole riser extension assembly of claim 13, wherein the locking elements comprise threaded fasteners threadedly received in holes through the lower spacer ring, and have points or drill tips configured to penetrate the locking tabs, to hold the assembly together, and to bear against the surface of the manhole frame with sufficient force to hold the assembly on the manhole frame.

16. The manhole riser extension assembly of claim 13, wherein the lower spacer ring is biasable radially inward by the cooperative engagement and bearing of the locking elements against the tabs, so as to exert a radially outwardly directed force against the tabs.

17. The manhole riser extension assembly of claim 13, wherein the upper spacer ring has at least a vertical dimension that can be varied to accommodate different manhole covers, frames and pavement heights.

18. The manhole riser extension assembly of claim 13, wherein the locking tabs are configured to be biasable or deformed radially outward by forceable contact with the respective locking elements bearing against the inner surface of the manhole frame.

19. The manhole riser extension assembly of claim 13, wherein the spacer rings have a round shape.

20. The manhole riser extension assembly of claim 13, wherein the spacer rings have an oval shape.

* * * * *